US005471233A

United States Patent [19]

Okamoto et al.

[11] Patent Number: 5,471,233

[45] Date of Patent: Nov. 28, 1995

[54] INK JET RECORDING APPARATUS

[75] Inventors: Toru Okamoto; Kazuo Maruyama, both of Kanagawa, Japan

[73] Assignee: Fuji Xerox Co., Ltd., Tokyo, Japan

[21] Appl. No.: 347,166

[22] Filed: Nov. 23, 1994

Related U.S. Application Data

[63] Continuation of Ser. No. 983,223, Nov. 30, 1992, abandoned.

[30] Foreign Application Priority Data

Jan. 29, 1992 [JP] Japan ..... 4-038789

[51] Int. Cl.[6] ..... B41J 2/01

[52] U.S. Cl. ..... 347/103; 347/88

[58] Field of Search ..... 347/103, 88, 99; 346/25

[56] References Cited

U.S. PATENT DOCUMENTS

| | | | |
|---|---|---|---|
| 3,653,932 | 4/1972 | Berry et al. | 347/99 X |
| 4,660,058 | 4/1987 | Cordery | 347/100 X |
| 4,779,099 | 10/1988 | Lewis | 347/71 |
| 4,833,486 | 5/1989 | Zerillo | 347/103 X |
| 4,882,593 | 11/1989 | Touma | 346/111 |
| 5,099,256 | 3/1992 | Anderson | 347/103 |
| 5,263,781 | 11/1993 | Mima | 346/135.1 X |
| 5,372,852 | 12/1994 | Titterington | 347/103 X |

FOREIGN PATENT DOCUMENTS

| | | | |
|---|---|---|---|
| 56-113462A | 9/1981 | Japan | B41J 3/04 |
| 60-90775A | 5/1985 | Japan | B41J 3/16 |
| 1-216863A | 8/1989 | Japan | B41J 3/20 |
| 2-265757A | 10/1990 | Japan | B41J 2/325 |
| 403190741 | 8/1991 | Japan | B41J 2/01 |
| 3-242667A | 10/1991 | Japan | B41N 2/325 |
| 403284948 | 12/1991 | Japan | B41J 2/01 |
| 404251747 | 9/1992 | Japan | B41J 2/015 |

*Primary Examiner*—Joseph W. Hartary

*Attorney, Agent, or Firm*—Finnegan, Henderson, Farabow, Garrett & Dunner

[57] ABSTRACT

A recording apparatus is disclosed comprising a recording head adapted to hold fusible ink, a transfer member facing the recording head without contacting it, heating means for heating the transfer member to a predetermined temperature, pressure applying means facing the transfer member in such a way that a recording medium can pass therebetween and cooperating with the transfer member for applying pressure to the recording medium, and voltage applying means for applying a voltage between the recording head and the transfer member, the recording head supplying the fusible ink in a molten state to the transfer member, the predetermined temperature being higher than the softening point of the ink and lower than the melting point of the ink, and the transfer member comprising materials having a surface energy approximately equal to the value of the critical surface tension of the ink and smaller than the surface energy of the recording medium.

7 Claims, 3 Drawing Sheets

INK JET RECORDING APPARATUS

This application is a continuation, of application Ser. No. 07/983,223 filed Nov. 30, 1992, now abandoned.

BACKGROUND OF THE INVENTION

1. Field of the Invention

The present invention relates to an ink jet recording apparatus, and in particular to a type of ink jet recording apparatus using a fusible ink.

2. Discussion of the Related Art

Conventionally, this type of ink jet recording apparatus has been described by, for example, Japanese Patent Application Unexamined Publication (laid-open) No. Sho. 56-113462 (1981) and Japanese Patent Application Unexamined Publication (laid-open) No. Sho. 60-90775 (1985).

Such an apparatus heats a fusible ink in a recording head and ejects it toward a recording medium by an electrostatic induction force in accordance with image information, thus forming an ink image on the recording medium.

According to this type of ink jet recording apparatus, it is possible to effectively avoid the problems which tend to occur when using a liquid ink at ordinary temperatures, such as ink leathering on plain paper, and drying or solidification of the ink in the recording head, causing obstruction of the recording operation.

However, because fusible ink solidifies as soon as it reaches the surface of the recording medium, the fusible ink forms raised areas on the recording medium. These ink areas tend to peel off when the ink image on the recording medium is rubbed, causing unsatisfactory mechanical print stability.

Another problem is that incident light is scattered because of the convexity of the ink areas and the color effect is impaired when a color image is formed on a transparent film sheet.

In this type of ink jet recording, moreover, since the distance between the recording head and the recording medium depends on the thickness of the recording medium, the diameters of the ink dots formed on the recording medium are similarly variable. These differences cause extreme deterioration of the image quality on some recording media.

SUMMARY OF THE INVENTION

The present invention has been made in view of the above circumstances and has as an object to provide an ink jet recording apparatus able to prevent the deterioration of the image quality caused by variations in the thickness of the recording medium.

Another object of the present invention is to provide an ink jet recording apparatus which preserves high fusing stability of the ink for a normal recording medium.

A further object of the present invention is to provide an ink jet recording apparatus which maintains a high color quality on a transparent film sheet.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the ink jet recording apparatus of this invention, as shown in FIG. 1 comprises a recording head 1 adapted to hold fusible ink 2 in it, a transfer member 3 located facing the recording head without contacting it, and a pressure applying means 6 facing the transfer member in such a way that a recording medium 5 can pass therebetween, and cooperating with the transfer member to apply pressure to the recording medium, wherein the recording head supplies the fusible ink in a molten state to the transfer member.

In such a mechanism, various kinds of recording heads can be considered, for example, the pulse-on-demand method using a piezoelectric element, the electrostatic induction method which ejects the ink by an electrostatic induction force, the thermo-electrostatic induction method that ejects the ink by combination of thermal energy and electrostatic induction forces, the electro-pneumatic control method which expands the ink by electrostatic induction force or the like and propels the expanded ink by a jet of air. However, it is at least necessary for these recording heads to be equipped with a head heating means 4 to heat the ink sufficiently that the ink temperature remains above its melting point until it reaches the recording medium.

Though any ink is satisfactory if it maintains a solid body at ordinary temperatures and melts at a predetermined melting point, it is preferable to add a liquid crystal polymer to the ink to allow both the fusing stability and the ejection characteristics to be improved.

The shape of the transfer member 2, whether it is a drum or belt type, does not make any difference as long as it functions to transfer the molten ink from the recording head to the recording medium under appropriate pressure.

It is necessary that the ink while soft is not absorbed into the surface layer of the transfer member but is held on the surface. Preferably, the wettability of the surface layer of the transfer member should be chosen so that the critical surface energy of the transfer member is approximately equal to the surface tension of the molten ink during the heating of the ink by the heating means, and after the image is formed on the transfer member, the height of the ink dots should slowly decrease as they expand gradually on the transfer member.

In a color image recording apparatus, recording heads which emit different colored ink may be arranged facing the transfer member so that ink dots of different colors are overlaid on the transfer member.

The heating means 4 can be built into the transfer member or can be installed outside the transfer member as long as it heats the transfer member to a predetermined temperature that is higher than the softening point of the ink but lower than the melting point of the ink. The ink held on the transfer member is softened, and therefore easily transferred to the recording medium. Thus a special device for cleaning the surface of the transfer member is not essential, but if thorough cleaning is preferred, it can be installed inside the color image recording apparatus.

In this process, the recording head 1 melts the ink and ejects it toward the transfer member in accordance with image information, and then the ink dots are held in a pattern corresponding to the image information on the transfer member.

Because the heating means 4 has heated the surface of the transfer member to a temperature higher than the softening point of the ink but lower than the melting point of the ink, the ink is soft on the surface of the transfer member.

The transfer member 3 carries the ink to the position of the recording medium where the ink is required, and presses the ink against the recording medium.

The image formed by the ink is easily transferred to the recording medium because it is pressed against the recording medium while it is soft.

If the transfer medium 5 is plain paper, part of the transferred ink is absorbed by the paper fibers and is then cooled by the paper to solidify. The remainder of the ink is squashed and spread on the surface of the paper, forming a flat ink surface, whereupon it cools and solidifies.

If the recording medium 5 is a non-absorptive one, such as a transparent film sheet, the ink on the surface of the transfer member is transferred to the recording medium and is squashed on the surface of the recording medium by pressure, flowing to form approximately circular dots, whereupon it cools and solidifies.

In this way, the ink is temporarily held on the heated surface of the transfer member, and then transferred to the recording medium by applying pressure optionally followed by secondary fusing, so that a flat ink image is formed.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

DETAILED DESCRIPTION OF THE PREFERRED EMBODIMENTS

Preferred embodiments of an ink jet recording apparatus according to the present invention will now be described in detail based on the drawings.

First Embodiment

Figure 1:
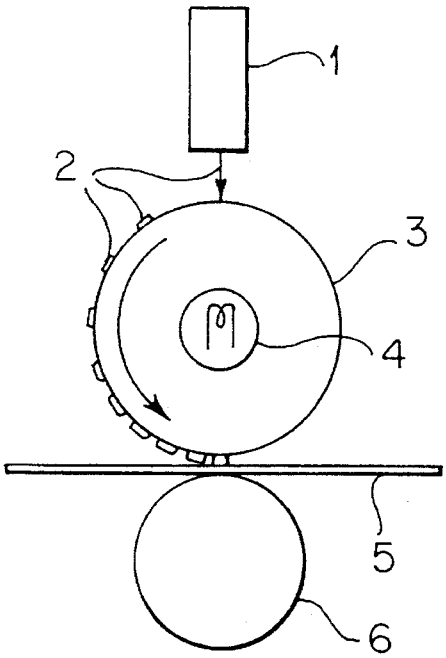
FIG. 1 illustrates the construction of an ink jet recording apparatus according to the present invention.
Figure 2:
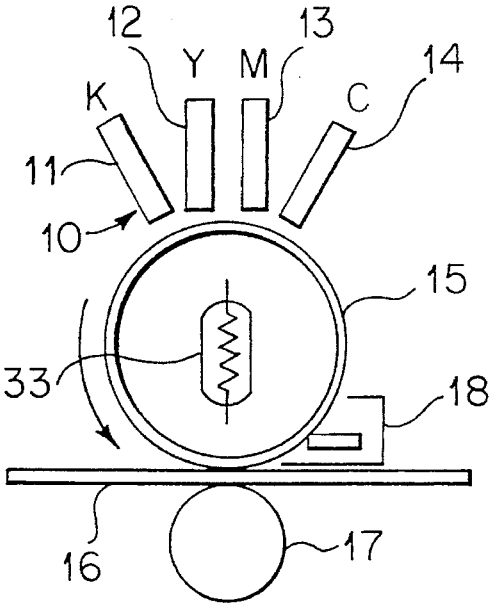
FIG. 2 illustrates the overall construction of a first embodiment of the ink jet recording apparatus according to the present invention.

FIG. 2 is a view illustrating the overall construction of a first embodiment of the ink jet recording apparatus according to the present invention.

In the figure, recording heads 10 include recording heads for four colors, namely, a black head 11, a yellow head 12, a magenta head 13 and a cyan head 14 and are arranged facing an transfer member 15.

These four-color recording heads 11–14 transfer ink for the corresponding color components to the surface of the transfer member based on image signals from a computer (not shown in the figure) to form an image. Here, 16 is a recording medium to which an ink image held on the transfer member 15 is transferred, 17 is a backing roller which supports the transfer medium 16 and provides pressure against the transfer member 15, and 18 is a cleaner which removes remaining ink, paper dust, foreign bodies and other dust.

Figure 3:
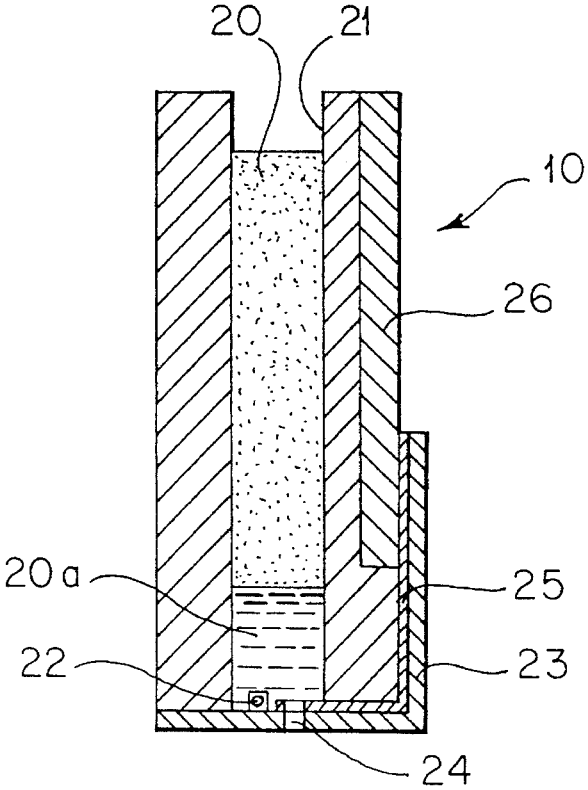
FIG. 3 illustrates details of a recording head used in the first embodiment of the ink jet recording apparatus according to the present invention.
Figure 4:
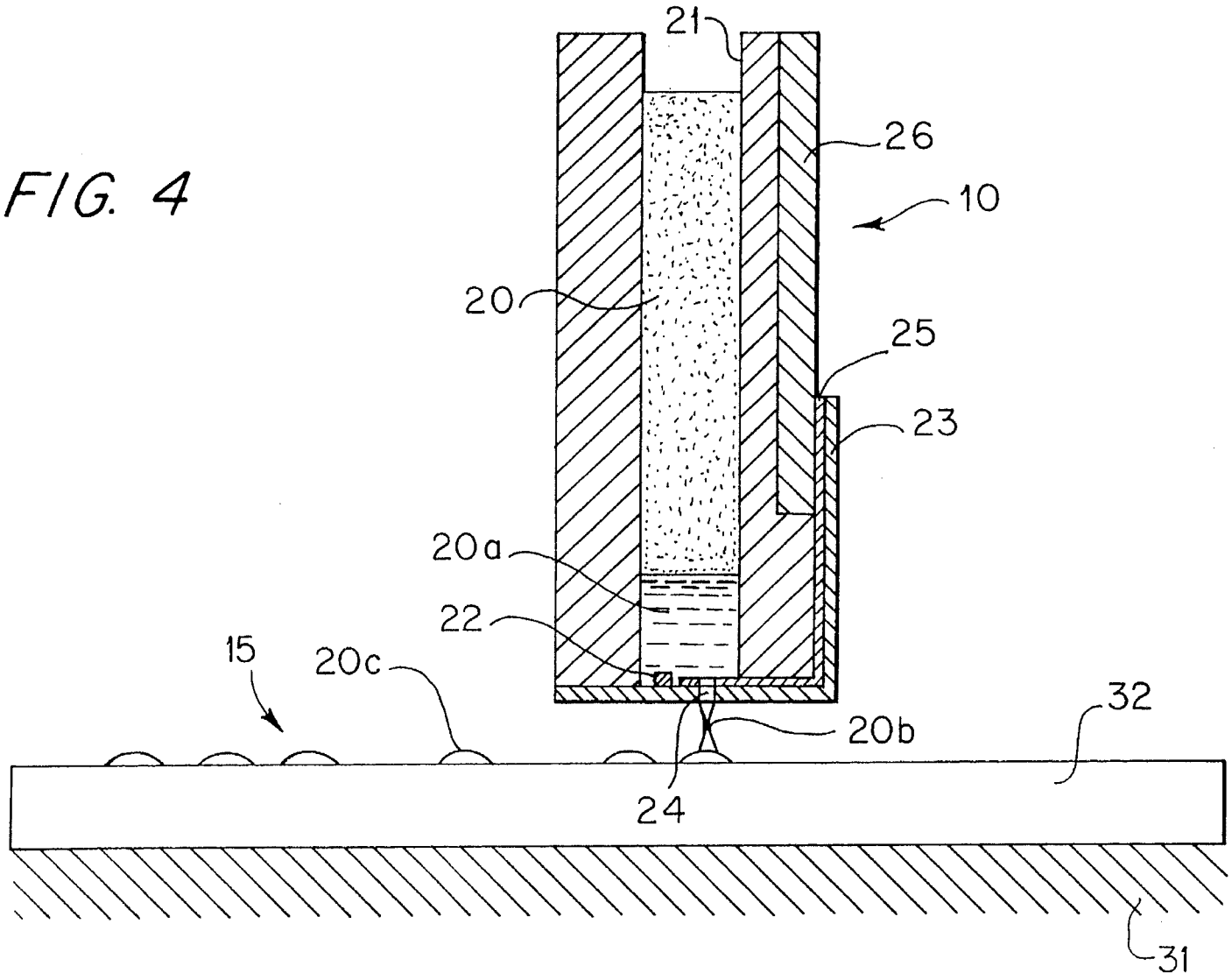
FIG. 4 illustrates the operation of the recording head used in the first embodiment of the ink jet recording apparatus according to the present invention.

FIG. 3 illustrates the construction of the recording head 10 for each color and FIG. 4 illustrates its operation.

In this embodiment, powder ink 20 is supplied to an ink reservoir 21 (by a supply means not shown in the figure). The powder ink 20 consists of straight chain polyethylene as principal ingredient, a dye of the appropriate color, an antioxidant, a viscosity controller, and so forth. In this embodiment, specifically, a straight chain polyethylene wax (Mitsui Petrochemical Industries, Ltd., "Hi-wax 110P") is used as principle ingredient, C.I. solvent black 23 is used as the coloring material and di-butylhidroxytoluene as the antioxidant.

Regarding the melting point of the ink, as a result of differential scanning calorimetry, an endothermic reaction was found in the range from 100° C. to 104° C. and the reaction peaks at 102° C. The surface tension of the molten ink is 26 dyne/cm (at 120° C.).

A head heater 22 is a thick-film resistance formed on a polyimide flexible substrate 23, to which is applied electricity by a head heater driving circuit (not shown in the figure) whether the apparatus is on stand-by or operating; the head heater 22 heats the powder ink 20 to a temperature above its melting point, thereby producing molten ink 20*a*.

The polyimide flexible substrate 23 has a plurality of orifices 24. In this embodiment, the polyimide flexible substrate is made of a photoconductive polyimide. The orifices 24 are formed in the process of developing the photoconductive polyimide. A liquid-repellent layer (not shown in the figure) is formed on the surface of the polyimide flexible substrate facing the transfer member 15, and preventing the molten ink 20*a* from flowing out of the recording head 10 whether by surface tension or otherwise.

The liquid-repellent layer consists of a fluororesin film and the value of its critical surface energy is measured as 15 dyne/cm, calculated from a contact angle measurement.

A plurality of control electrodes 25 are formed on the inside surface of the polyimide flexible substrate 23. The orifices 24 and the control electrodes 25 form a line covering the maximum width of the recording medium at the dot interval required by the apparatus. These orifices 24 and control electrodes 25 provide a parallel printing mechanism, which results in improvement of the printing speed.

In this embodiment, one control electrode 25 is made to surround one round orifice 24, and comprises a copper foil bonded to the polyimide flexible substrate 23 by an epoxy resin adhesive, and then subjected to a photo-etching process.

The control electrode 25 is welded by pressure to an anisotropic film formed on a picture element driving board 26, which supplies a large number of control electrodes 25 with a high voltage (in this embodiment, 400 V). In this embodiment, the picture element drive board 26 is formed as an array of thin-film transistors to withstand high voltages and a shift register for serial-parallel conversion of image data.

The transfer member 15 comprises an ink transfer drum having an aluminum base material 31 and a surface layer 32. The surface layer 32 is made from silicone rubber doped with carbon filler to prevent charge accumulation. Since the surface tension of the molten ink 20*a* is 26 dyne/cm, a silicone rubber having approximately the same surface tension is selected. As a result, the critical surface energy of the surface layer 32 is 31 dyne/cm.

A bias pulse voltage of −1 kV is applied to the base material 31 of the ink transfer drum and a pulse voltage of +400 kV is applied to the control electrodes 25 by the picture element drive board 26 in accordance with the image, whereby the part of the molten ink 20*a* near the orifice 24 is affected by the Coulomb force and is propelled to the transfer member 15, forming an ink thread 20*b*. The surface layer 32 is heated to the softening point of the ink by a heater 33 for heating the transfer member 15. In this embodiment, since the surface tension of the ink and the surface energy of the surface layer of the ink transfer drum 32 are almost the same, the dots formed by ink threads 20*b* slowly continue to expand and finally form a relatively flat ink image 20*c*.

Subtractive color mixing is carried out on the transfer member 15. The transfer member 15 is less subject to changes in dimension caused by changes in the external environment compared with paper or the like due to its construction, and therefore registration of colors is straightforward with higher accuracy than is possible on paper.

Figure 5:
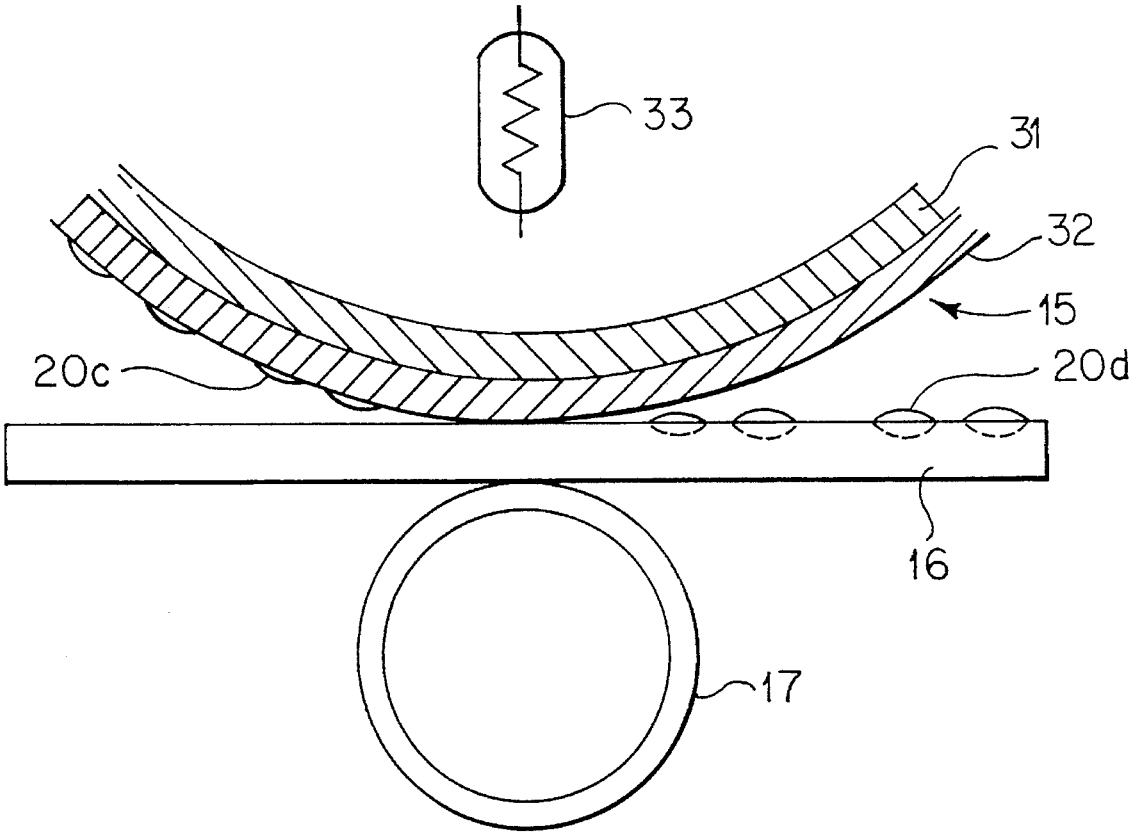
FIG. 5 illustrates the operation of an transfer member used in the first embodiment of the ink jet recording apparatus according to the present invention.

FIG. 5 shows the operation of transfer from the transfer member 15 to the recording medium 16 and secondary fusing. In the figure, the heater 33 heats the transfer member 15 so that the temperature of the surface of the transfer member 15 is above the softening point of the ink 20 but below the melting point of the ink. The recording medium 16, consisting of plain paper, is supplied between the transfer member 15 and the backing roller 17 by a paper feeding device (not shown in the figure).

The transfer member 15 is controlled to be at 100° C., the temperature at which the ink begins to melt, by a temperature controlling device (not shown in the figure).

When the linear pressure (the force per unit length of the transfer member) that the transfer member applies to the recording medium 16 is in the range from 1 to 10 kg/cm, the ink is transferred adequately. If the linear pressure is above this range, problems occur such as wrinkling of the paper, unnecessarily thick lines or excessively squashed dots. If the linear pressure is less than 1 kg/cm, a large number of dots do not properly contact the recording medium, and resulting in transfer defects or non-uniform transfer within an image area, which is undesirable.

The temperature of the image formed by the four-color recording heads 10 is kept at the softening point of the ink of 100° C., and then transferred to the recording medium 16. In this embodiment, the material of the surface layer of the ink transfer drum 32 is selected so that the surface energy of the surface layer of the ink transfer drum 32 is approximately the same as the surface tension of the molten ink 20*a*, and is sufficiently lower than the surface energy of the recording medium. The ink is transferred from the transfer member 15 to the recording medium 16 because of the difference of the surface energy between the transfer member 15 and the recording medium 16.

Since the temperature of the ink 100° C., its softening point, and pressure is supplied by the backing roller 17, the ink 20*c* is deformed so that the surfaces of the dots become flat. Moreover, in the case that the recording medium 16 is plain paper, detachment of the ink caused by rubbing is reduced and the ink maintains a sufficiently high optical density because squashed ink 20*d* covers the bare surface of the paper.

Because the surface layer of the ink transfer drum 32 of this embodiment is made of a comparatively soft material, that is, silicone rubber, a metal roller formed from a chromium-plated steel tube is employed as the backing roller 17. Substantially the same effect can also be obtained by making the transfer member 15 of hard material and the backing roller 17 of a softer material.

Plain paper for electrophotography (P-series paper manufactured by Fuji Xerox Co., Ltd.) is employed as the recording medium 16, whose critical surface energy ranges from 50 to 100 dyne/cm according to the contact angle measurement. Since the difference between the critical surface energy of plain paper and that of the surface layer of the ink transfer drum 32 is 19–20 dyne/cm, the ink can be transferred adequately by this difference in the surface energy.

The rate of successful ink transfer from the transfer member 15 to the recording medium is actually 100 %, and therefore it is not necessary to remove the remaining ink after transfer. However, there is a possibility that the recording medium 16 may transfer fibers, dust and the like to the transfer member 15.

Because the space between the recording head for each color 10 and the transfer member 15 is some tens or hundreds of micrometers, it is preferable not to transfer these relatively large paper fibers or dust to the printing position. A cleaner 18 is installed to trap dust whose particle size is more than some tens of micrometers.

As described above, an ink image can be formed, which is flat and excels in fusing stability and color developing on transparent film sheet by a simple construction according to this embodiment.

Furthermore, the smooth surface layer of the transfer member 32, enables flat dots to be generated such that the image on the recording medium 16 also provides good color reproduction according to this embodiment.

Second Embodiment

In this embodiment, the ink differs from that of the first embodiment in that the principal ingredient is aromatic polyester thermotropic liquid crystal polymer ("Novaculate" manufactured by Mitsubishi Kasei Corp., without filler) and carbon black is used as a pigment.

An ink image is formed on the transfer member 15 which is the same as that of the first embodiment by a so-called Stemme-type pulse-on-demand ink jet recording head, and then transferred to the polyethyleneterephthalate film, thus a well-conditioned image is obtained.

In this embodiment the Stemme-type recording head comprises 24 integrally formed nozzles and its temperature is kept at 300° C. while in used. A serial scanning control system scans in the direction of the ink transfer drum axis and when one round of scanning is over, the transfer member 15 rotates through an amount corresponding to 24 dots. The transfer member 15 is heated so that the temperature of its surface is 200° C. for fusing.

Ink transferred in the way described above to a transparent film sheet (polyethyleneterephthalate) forms an image with a high stability, and therefore the problem of parts of the image breaking off does not occur in a scratch test. Moreover, even though the transparent film sheets are left in a pile at a temperature of 100° C., they do not stick to each other.

Furthermore, as the molten ink is subject to a shear force, the liquid crystal polymer causes the apparent viscosity of the ink to decline and the ejection speed increases; thereby the printing gap (the distance from the recording head to the transfer member) can be increased. In general, if the melt viscosity of a resin is low, it may be insufficiently fused in many cases because of its low room temperature hardness. On the other hand, a liquid crystal polymer is relatively hard at room temperatures though its melt viscosity is low in a high shear state. So the ejection characteristics and fusing stability of the ink can easily both be improved.

Third embodiment

Figure 6:
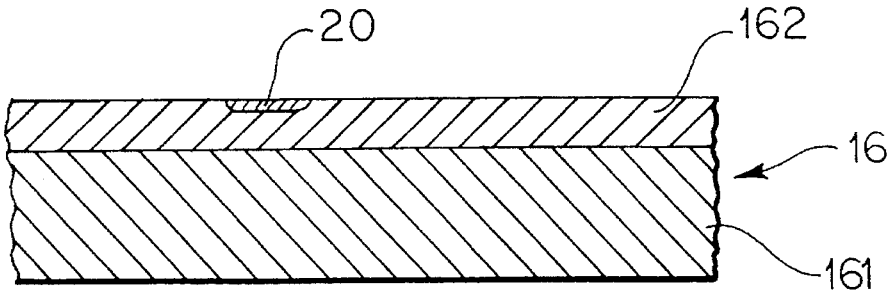
FIG. 6 illustrates a recording medium employed in a third embodiment of the ink jet recording apparatus according to the present invention.

As shown in FIG. 6, polyethyleneterephthalate 161 having a thickness of 80 μm is coated with molten transparent polyethylene wax 162 of thickness 20 μm to make a waxy transparent film sheet 16 as a recording medium which is used for color printing using the first embodiment of the ink jet recording apparatus and the ink.

Because the ink 20 is, at the transfer point, embedded in the transparent polyethylene wax 162 previously applied to the polyethyleneterephthalate 161, flatter ink dots can be formed than those made in the first embodiment. Moreover, by using the waxy transparent film sheet 16 of this embodiment, completely flat ink dots can be formed even if an excess of ink is transferred. Thus satisfactory color reproduction can be obtained even in portions of high optical density.

Fourth embodiment

By an apparatus having a construction like that of the first embodiment shown in FIGS. 2 and 3 the fusible ink can be transferred without heating the transfer member. An aluminum alloy roller is employed as the transfer member 15 and the backing roller 17 is a steel roller coated with polyacetal resin. The critical surface energy of the transfer member 15 is 50 dyne/cm according to the contact angle measurement.

Since the above-mentioned rollers have high stiffness, even though higher pressure than in the first embodiment is applied to these rollers, wrinkling does not occur.

Straight chain polyethylene and a dye of the same type as of the first embodiment is used as the ink. In selecting an appropriate ink, the following properties need to be taken into consideration: the durability of the ink against rubbing and folding while it is on the recording medium, with hardness suitable to room temperature, the plastic deformation of the ink without cracking at room temperature, safety matters and so forth. Other than polyethylene, fatty acid metallic salts, vegetable wax, carnauba wax, for example may preferably be used.

Because the transfer member 15 is not heated, the degree of crushing of the ink depends on the rheological characteristics of the ink and the pressing force. It is necessary to apply higher pressure to the transfer member 15 than in the first embodiment because the ink is less plastic at room temperature than when it is softened. As shown in the table below, the image can be transferred when the linear pressure ranges from 5 kg/cm to 50 kg/cm. If the linear pressure is below this range, the image cannot be transferred. On the other hand, when the linear pressure is above this range, the transferred image is excessively deformed and the recording medium has an excessive gloss. More preferably the linear pressure should be 10 kg/cm to 20 kg/cm.

The reason why an image can be transferred from the transfer member 15 whose critical surface energy is more than 50 dyne/cm to paper having approximately the same critical surface energy is, according to the consideration of the inventors of the present invention, as follows: the ink having been plastically deformed between the rollers permeates into the paper fibers and physically combines with them, thereby being transferred to the paper. Moreover, since the straight chain polyethylene ink has good release characteristics, almost none remains on the surface of the transfer member.

TABLE

Relation between transfer temperature/linear pressure and transfer condition/image quality

| | 0.5 kg/cm | 1 kg/cm | 2 kg/cm | 5 kg/cm | 10 kg/cm | 20 kg/cm | 60 kg/cm |
|---|---|---|---|---|---|---|---|
| Fourth embodiment room temperature (25° C.) | not transferred | not transferred | not transferred | dots of 50 μm and less are not transferred | good | good | excessive deformation and paper gloss |
| First embodiment softening point (100° C.) | non-uniform transfer | good | good | good | good but somewhat deformed | wrinkling occurs | wrinkling occurs |

As explained above, according to the present invention, the transfer member is heated, the image formed by the ink is held on the transfer member for while in a softened state, and is then transferred to the recording medium by pressure to form a flat ink image on the surface of the recording medium by squashing the ink. Therefore, the susceptibility to peeling of the ink is reduced, and a satisfactory transfer quality can be realized. Furthermore, the optical density of the ink image is increased insofar as the ink absorption into the recording medium is reduced and the ink image in the recording medium has good long term lasting characteristics.

Moreover, in the case that an image is printed in full color on a transparent film sheet, a high coloration quality is maintained on the surface of the transparent film sheet because a flat ink image can be formed.

Since the ink image output from the recording heads is first held on the transfer member, and then transferred to the recording medium under pressure, there is no variation in the distance between the recording head and the transfer member with different recording medium thickness, and accordingly the diameters of the ink dots are maintained constant. Thus deterioration caused by variation in the size of the ink dots is effectively prevented.

Furthermore, expansion or contraction of the transfer member can for practical purposes be ignored since the transfer member is able to accept a precise amount of ink and provide a consistent pressure, which makes color registration easy to achieve in comparison with an apparatus which superimposes ink images of several colors directly on a recording medium.

In particular, according to the ink jet recording apparatus claimed in claim 11, the composition of the fusible ink is improved so that the transfer and fixing characteristics of the ink can both be of a high level.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink jet recording apparatus comprising:

a recording head adapted to hold fusible ink;

a transfer member facing said recording head without contacting it;

heating means for heating said transfer member to a predetermined temperature;

pressure applying means facing said transfer member in such a way that a recording medium can pass therebetween, and cooperating with said transfer member for applying pressure to said recording medium; and voltage applying means for applying a voltage between said recording head and said transfer member;

said recording head supplying the fusible ink in a molten state to said transfer member, said predetermined temperature being higher than the softening point of said ink and lower than the melting point of said ink, and said transfer member comprising materials having a surface energy approximately equal to the value of the critical surface tension of said ink and smaller than the surface energy of said recording medium.

2. An ink jet recording apparatus according to claim 1, wherein the linear pressure applied by said pressure applying means is in the range from 5 kg/cm to 50 kg/cm.

3. An ink jet recording apparatus according to claim 2, wherein the linear pressure applied by said pressure applying means is in the range from 10 kg/cm to 20 kg/cm.

4. An ink jet recording apparatus according to claim 1, wherein said ink contains a liquid crystal polymer.

5. An ink jet recording apparatus according to claim 1, wherein the linear pressure applied by said pressure applying means is in the range from 0.5 kg/cm to 10 kg/cm.

6. An ink jet recording apparatus according to claim 5, wherein the linear pressure applied by said pressure applying means is in the range from 1 kg/cm to 5 kg/cm.

7. An ink jet recording apparatus according to claim 1, wherein said recording head has an ink supplying area with a surface energy smaller than said value of critical surface tension of said ink.

* * * * *